United States Patent [19]

Virta et al.

[11] Patent Number: 4,722,154

[45] Date of Patent: Feb. 2, 1988

[54] ROOM UNIT FOR MARINE STRUCTURE

[75] Inventors: Hannu Virta, Turku; Unto Asikainen, Raisio; Kari Kostiainen, Littoinen; Jarmo Wacker, Kaarina, all of Finland

[73] Assignee: Oy Wärtsilä Ab, Helsinki, Finland

[21] Appl. No.: 932,922

[22] Filed: Nov. 19, 1986

[30] Foreign Application Priority Data

Nov. 28, 1985 [FI] Finland ..... 854702

[51] Int. Cl.[4] ..... B63B 29/02; B63B 15/00

[52] U.S. Cl. ..... 52/79.1; 52/167; 114/189; 114/77 R

[58] Field of Search ..... 52/79.1–79.9, 52/167; 114/71, 189

[56] References Cited

U.S. PATENT DOCUMENTS

| | | | |
|---|---|---|---|
| 2,749,592 | 6/1956 | Vartia | 52/745 |
| 4,091,581 | 5/1978 | Abbott | 52/79.1 |
| 4,096,675 | 6/1978 | Howard et al. | 52/745 X |
| 4,226,677 | 10/1980 | Saito et al. | 52/167 X |
| 4,258,516 | 3/1981 | Mori et al. | 52/167 X |
| 4,517,778 | 5/1985 | Nicolai | 52/167 |
| 4,528,928 | 7/1985 | Virta et al. | 114/189 |
| 4,565,039 | 1/1986 | Ogaro et al. | 52/167 |
| 4,599,834 | 7/1986 | Fujimoto et al. | 52/167 |

FOREIGN PATENT DOCUMENTS

| | | | |
|---|---|---|---|
| 2541361 | 3/1977 | Fed. Rep. of Germany | 114/71 |
| 38191 | 3/1984 | Japan | 114/71 |

*Primary Examiner*—J. Karl Bell

*Attorney, Agent, or Firm*—Dellett, Smith-Hill and Bedell

[57] ABSTRACT

A room unit (1) and a method for the construction and the position mounting of the box-like room unit (1), for instance a cabin, a module assembled from room elements or the like. The room unit intended for an arrangement operable in marine enviroments, for instance for a ship, an offshore construction or the like. The room unit is located on an at least mainly even underlaying (14) of the arrangement, for instance on a ship's deck (14). The method comprises the inclusion of the room unit (1) with a roof (4), walls (2,3) and a floor (12), the lower portion of the wall (2,3) being attached at the outer edge of the self-supporting floor (12). The floor (12) is provided by adjustable damping appliances (21) operable from the interior of the room unit (1). The moving of the room unit (1) is carried out by supporting the unit (1) temporarily at a bag-like air cushion device and at one stabilizing device at least. The room unit (1) is after the removal of the temporary support mounted at its position by attaching the damping appliances (21) at said even underlaying (14). The floor (12) of the room unti (1) is adjusted in a desired orientation by trimming the room unit (1) supported by the damping appliance (21) and said floor (12) is adjusted at least mainly out of contact with the underlaying (14) by means of the adjustment of the damping device (21).

34 Claims, 4 Drawing Figures

ROOM UNIT FOR MARINE STRUCTURE

PRIOR ART

Room units like a ship's cabins or accomodation modules in an off-shore construction are mounted on an even underlaying of the marine arrangement, for instance on the deck. Patent Letters No. GB 1 600 110 and U.S. Pat. No. 4,091,581 present cabins comprising a floor and attached at the deck either directly or via a pedestal. A problem in this structure is the vibration transmission from the ship's deck to the cabin. Attempts have been made to eliminate the problem by a floor element, like a glass fibre plate or -carpet located between the deck and the floor of the cabin. An example is presented in in the conference report nstm 77, Lyngby, "Utrustningselementkonstruktioner," page 13 (in Norwegian). U.S. Pat. No. 4,528,928 presents a cabin without a regular floor. The cabin is usually mounted directly on the deck. It can also be mounted on a flexible floor element arranged on the deck. This floor element is usually a steel plate and a glass fibre plate located between the steel plate and the deck.

The vibration noise level in the cabin can be diminished by the familiar glass fibre element, if the glass fibre layer is thick enough. The flexible floor element adds significantly to material expenses and the total labour volume of the cabin. This is a result of manufacturing and mounting arrangements, which are separate from the remaining cabin structure. If the thickness of the steel plate is 4 mm, the weight of a cabin including a bottom area 10 $m^2$ will increase nearly 300 kg, which increases considerably the excess load in a passenger ship comprising several hundred cabins. Empirically has been found out, that the noise level decreases significantly first, if the thickness of the glass fibre layer is at least 50 mm. The floor of a mounted cabin is hereby located higher than the deck, whereby the vertical dimension of the ship's deck must also count for this excess amount.

Patent Lettters No. DD 88264 and the German Utility Model No. DE-GbM 7809105 disclose a vibration damper attached at the cabin element body and located below the cabin. The problem in this arrangement is that the damper lifts the cabin considerably above the deck level. If a rubber-like base plate having a constant height is used, the cabin can even be located in a skewed orientation as the result of local irregularities of the deck. An adjustment of the adjustable damper is difficult, perhaps impossible, in the vicinity of the ship's bulkhead, which is easily understood from the drawing of the quoted Utility Model.

THE OBJECTS OF THE INVENTION

The object of the invention is to provide a room unit and a method for the production of the room unit so that the aims presented in the following are achieved. The term "a basic unit" in this content relates to a room unit mounted directly on a deck, for instance a cabin. The aims:

- the noise level is considerably reduced in the invented room unit, when compared to the basic unit,
- the new room unit is not located considerably above the underlaying, preferably less than the height increase caused by a glass fibre layer resulting in the same noise reduction in the basic unit,
- the orientation and the location of the room unit relative to the underlaying are adjustable through measures carried out from the interior of the room unit,
- the room unit can be attached at the underlaying through measures carried out from the interior of the room unit.

SHORT DESCRIPTION OF THE INVENTION

The noise level reduction is possible by means of the adjustable damper appliance, the effect of which is boosted up by arranging the floor at least mainly out of contact with the underlaying. The positioning of the room unit relative to the floor can be governed by locating the damper appliances in conjunction with the floor. It is hereby possible to adjust the floor more close to the underlaying than according to the prior art. The orientation and location of the room unit can be adjusted by the damper appliance being in conjunction with the floor; the same applies to the attachment of the room unit at the underlaying. By means of the self-supporting floor, the floor does not reqire the support from the underlaying, which can be, thus, detached from the floor.

The effect of the invented method is boosted up in a favourable embodiment, in which the damper appliance is arranged below the upper surface of the floor. A vibrations attenuation arrangement is hereby located between the floor and the underlaying. The upper surface of the floor produced from cassette units is thus unobstructed, whereby the mounting of furniture, the carpet etc is unobstructed.

It is easy to adjust the damper appliance, which is in connection with the room unit interior and is arranged in conjunction with an opening produced in the floor. Such damper appliance is attachable through uncomplicated measures at the underlaying, for instance by welding. The support of the entire room unit is realized by flexible damper appliances.

The room unit according to the invention is provided with at least one adjustable damper appliance, which is located in conjunction with the self-supporting floor. The self-supporting floor is attached at its edge portions at the lower portion of the walls. By means of this arrangement the room unit is supported at the underlaying via the damper appliance. As a result of this arrangement, the structure-bound vibrations of a marine arrangement, for instance of a ship, are transmitted to the room unit considerably attenuated, whereby the noise level of the room unit is reduced. The damper appliance comprises members which support the floor, members for the attachment of the appliance at the underlaying and for the adjustment of the floor orientation through measures carried out from the interior of the room unit. By means of the damper appliance being in conjunction with the floor, the room unit is lifted above the underlaying by a separation, which is considerably smaller than that presented in the East German Patent Letters No. DD 88 264. The reduction of the noise level is boosted up by arranging the room unit at least mainly out of contact with the underlaying. Other bridging-over connections can also hereby exist between the room unit and the underlaying, like pipings of heat, water, sanitary, air conditioning arrangements, electrical conductors and fire extinguish arrangement with eventual protective pipes etc.

The effect of the invention is boosted up by arranging the damper appliance in the floor arrangement so, that the appliance is located below the upper surface of the floor, which is produced from self-supporting cassette units. The essential floor area is hereby unobstructed. The floor arrangement is so realized, that the damper appliance can be attached and it can be adjusted. An uncomplicated floor arrangement comprises a mainly round opening, which extends through the floor. In the most favourable floor arrangement, each opening is located in a corresponding cassette unit, which is produced from a profiled load-bearing plate element and a thin plate housing surrounding it.

The damper appliance comprises a rigid body member supporting the floor, a base attachable to the underlaying and an adjustment member for the separation adjustment between the base and the body member. The vibration transmission is attenuated by a member, which is arranged in the base. The adjustment member is for instance a screw member and the attenuation member is produced from a material, which is flexible, plastic, yielding or has a fibre structure. As examples are presented a harmonically operated spring member or rubber-like flexible member, a member produced from polyethylene or PVC or the like polymeric material, or for instance a member, which yields like polystyrene. Mineral wool or glass wool suits for fibre material, for instance in form of plates or carpets.

The damper appliance supports the floor at the lower surface of the floor. The adjustment members of the appliance extend to the vicinity of the upper surface of the floor. Adjustment members can be provided with members which lock the desired adjustment position. The influence of the irregularities and the skewness of the underlaying is easily compensated, when the vertical adjustment range of the damper appliance is at least 0 . . . 25 mm, preferably 0 . . . 40 mm. Hereby the vibrations absorbing material is adjusted between the floor and the underlaying, for instance flexible or yielding mineral wool or glass wool. By means of this arrangement such vibrations are attenuated which exist in the underlaying and pass through air to the floor. A suitable material density is usually below 100 $kg/m^3$.

The body member of the damper appliance comprises a depression so, that the adjustment meember is entirely located deeper than the upper surface of the body member, the term "deep" relating to "vertically downwards". By this means the body member can be extended to the vicinity of the upper surface of the floor without generating obstacles on the floor. The radially directed flange of the body member supports the floor at the lower surface of the floor and in the vicinity of the round opening located in the floor.

The damper appliance can be attached to the lower surface of the floor through screws, glue or the like, especially for the transport of the room unit to the mounting location, where the damping appliance is fixed by welding at the underlaying. The attachment can be realized by welding the metallic head plate of the base at the underlaying, for instance in conjunction with the attachment opening of the head plate.

The self-supporting floor cassette unit comprises members which are mutually attached by glue so, that the cassette unit extends in the vertical direction about 25 . . . 50 mm, preferably 25 . . . 40 mm. By this means a firm enough and loadbearing unit is realized which at the same time requires little space in the vertical direction.

BRIEF DESCRIPTION OF THE DRAWING

The invention is described more in detail with reference to the attached drawing, in which.

PREFERRED EMBODIMENT OF THE INVENTION

Figure 1:
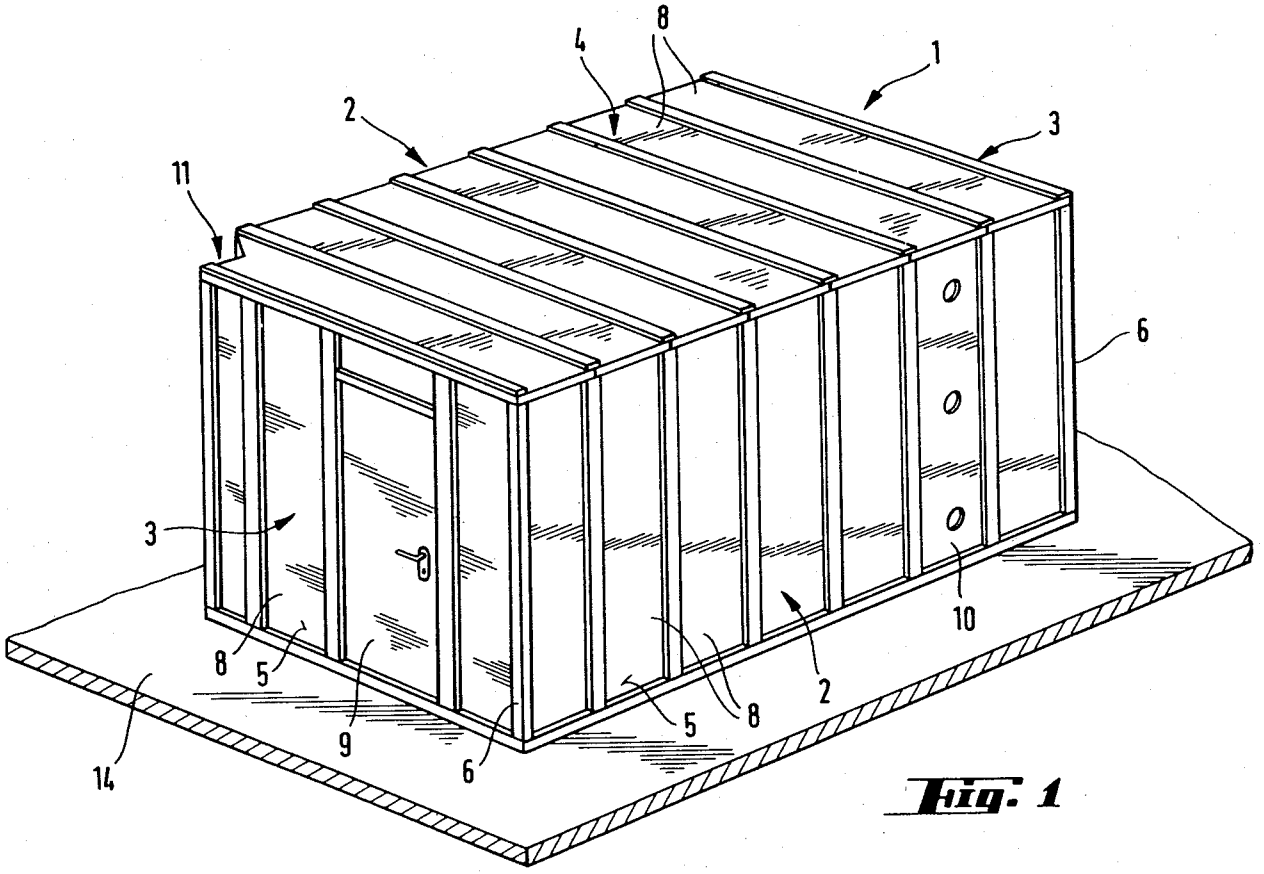
FIG. 1 is a general illustration of an embodiment of the room unit according to the invention.
Figure 2:
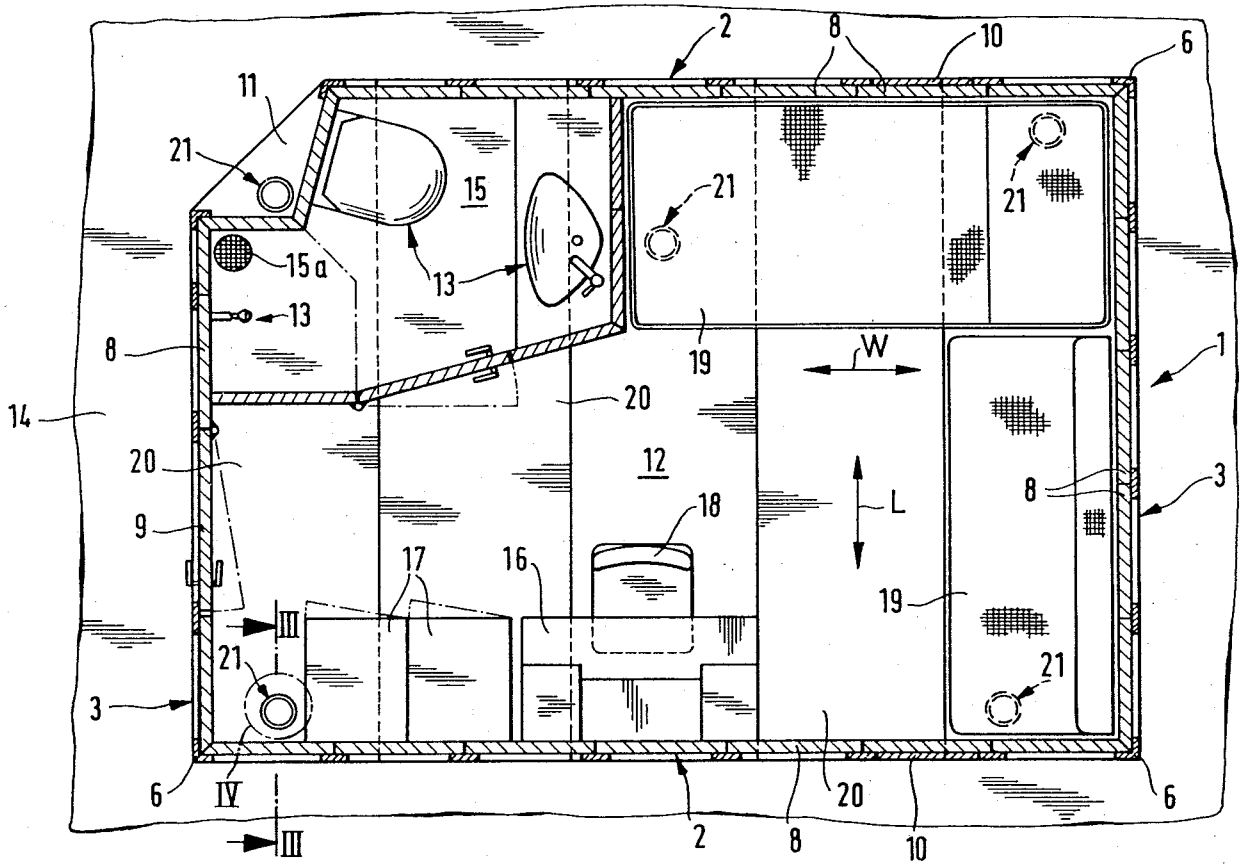
FIG. 2 is a partly sectioned top view of a cabin unit embodiment.

A cabin unit 1 comprises walls 2, 3, a roof 4 and a floor 12 (FIG. 2). The lower portion 5 of wall 2,3 is attached at the floor. A corner 6 of walls 2,3 is formed by suitable means. Walls 2,3 and roof 4 are made from thin plate mineral- or glass wool structure cassette units 8. The door of the cabin is marked by the reference numeral 9.

Load-bearing support plates 10 are attached to suitable location of cabin walls 2,3, which plates 10 give supprt to heavy furniture pieces which are attached at the walls. In one cabin corner is located an exterior channel space 11 for heat, water, sanitary and air conditioning, electrical etc. arrangements. The ship's deck is marked by the reference numeral 14. Cabin floor (FIG. 2) covers mainly the internal bottom area of the cabin. The cabin is provided with a usual self-supporting, separate water closet and bath room space, which comprises sanitary appliances 13, an own water tight floor construction 15 with a floor drain 15*a*. Floor 15 is located above floor 12 so that a space is between between them, in which he necessary pipe etc. members are arranged. Floor 12 does not necessarily not cover the entire area located below floor 15.

A table 16, a clothes rack 17, a bed 19 and a suitable number of detached chairs 18 are located in the cabin.

Floor 12 is made from cassette units 20. The floor can as well be constructed from a single cassette unit 20. Floor 12 is provided with a suitable number of damping appliances 21 so that the load generated by the cabin is evenly distributed among appliances 21. Damping appliance 21 is preferably located away from a normal passage path, for instance under table 16 or bed 19, in a corner, or outside the cabin wall, for instance in channel space 11. Damping appliance 21 can in the last mentioned arrangement be supported at the outer wall of the water closet space, be located in the space between floor 15 and floor 12, or be located in a shortened cassette unit 20, which only partially covers the bottom area of channel space 11.

The spacing of floor cassettes 20 in FIG. 2 is for clarity reasons different from the cassette spacing of walls 2, 3. The spacings can, however, be suitable chosen, for instance they can be equal.

Figure 3:
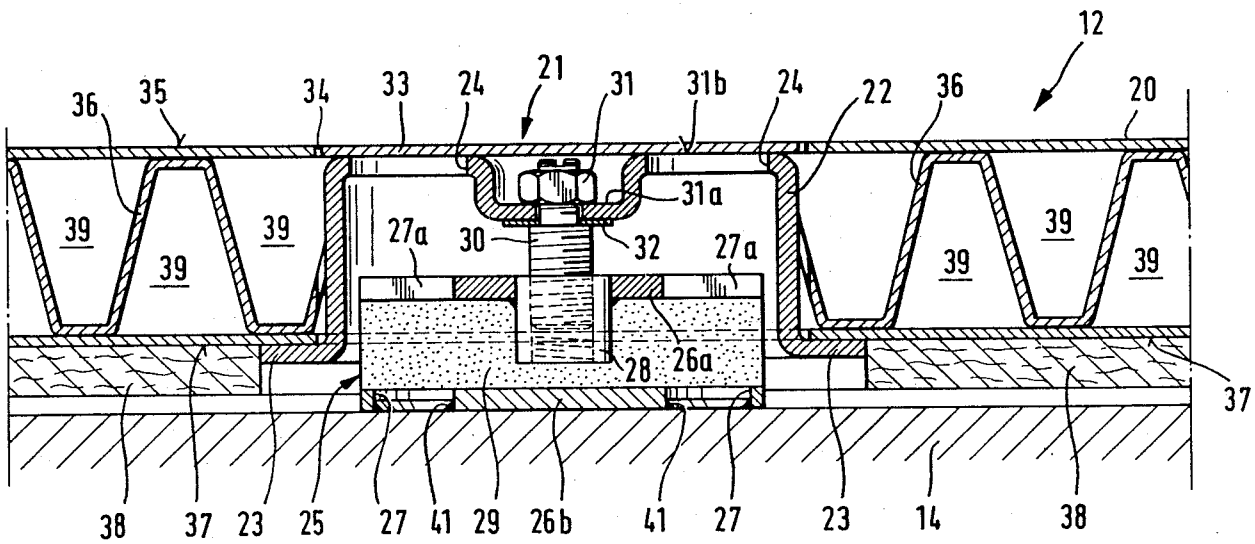
FIG. 3 is a partial illustration of the section III—III of FIG. 2.

FIG. 3 illustrates damping appliance 21 a bit more in detail. A body 22 of appliance 21 comprises a radial flange 23, openings 24 at the upper portion of body 22 and a base 25 at the lower portion of appliance 21. Base 25 comprises an upper metal plate 26*a* and a lower plate 26*b*, which comprises openings 27. Upper plate 26*a* comprises opening slots 27*a* and a bushing 28 which is attached at plate 26*a*. Flexible rubber pads 29 (FIG. 4) are located between plates 26*a* and 26*b*. Instead of two pads 29 one can also apply a single rubber pad, which comprises suitable openings for bushing 28, whereby the unrestricted connection exists between openings 27 and 27*a*.

Body 22 and base 25 are connected by a screw 30, the thread portion of which corresponds the threads of bushing 28. The head of screw 30 and a locking nut 31 are so arranged, that they are located in a depression 31*a* of body 22 slightly below the upper surface 31*b* of body 22. The rotatable support of the unthreaded portion of screw 30 at body 22 is supported by usual way through a shoulder 32. One can place a locking lid 33 above damping appliance 21, which lid 33 together with locking nut 31 prevents the unintended rotation of the screw. The load-bearing floor cassette comprises a round opening 34.

Opening 34 and damping appliance 21 and locking lid 33 are so adjusted relative to floor 12 or to cassette 20, that the upper surface 35 of the cassette is at the same level as, or preferably slightly above than, damping device 21, about 0 . . . 2 mm at the most.

The floor cassettte comprises a fairly rigid, load-bearing profiled plate 36, which is attached by means of glue at a thin plate profile, which surrounds profiled plate 36. A single thin plate profile, for instance, forms the upper surface 35 and lower surface 37 of cassette 20. The junction portion of the surfaces is not shown in detail. The cassette has a constant dimension in the direction W(FIG. 2); it can be cut to a definite dimension in the direction L and the cut locations can be canted as known per se.

A thin layer 38 of mineral- or glass fibre wool is glued at lower surface 37 of cassette 20. Hereby vibrations existing in the air space between lower surface 37 and underlaying 14 are damped, which vibrations otherwise would pass through air into cassette 20. The main support of floor 12, and thus the support of the cabin also, is realized by means of damping appliances 21. Hereby cassette 20 or floor 12 can be located so deep, that only a light contact exists between underlaying 14 and layer 38. A thin layer 38 of thickness about 8 . . . 25 mm can favourably be provided. Air gaps in said space close and layer 38 is nevertheless loose and, hence, does not transmit vibrations which pass via solid materials. The cabin is slightly lowered, when producing said light contact.

Cassette 20 comprises an air space 39 which is confined by surfaces 35,37 and plate 36.

Base 25 is attached at underlaying 14 through its lower plate 26*b* by means of a welding attachment 41 within opening 27. The attachment is easily carried out. After the removal of locking lid 33, a direct connection is available from the interior of the cabin to underlaying 14 through openings 24,27*a* and 27.

Figure 4:
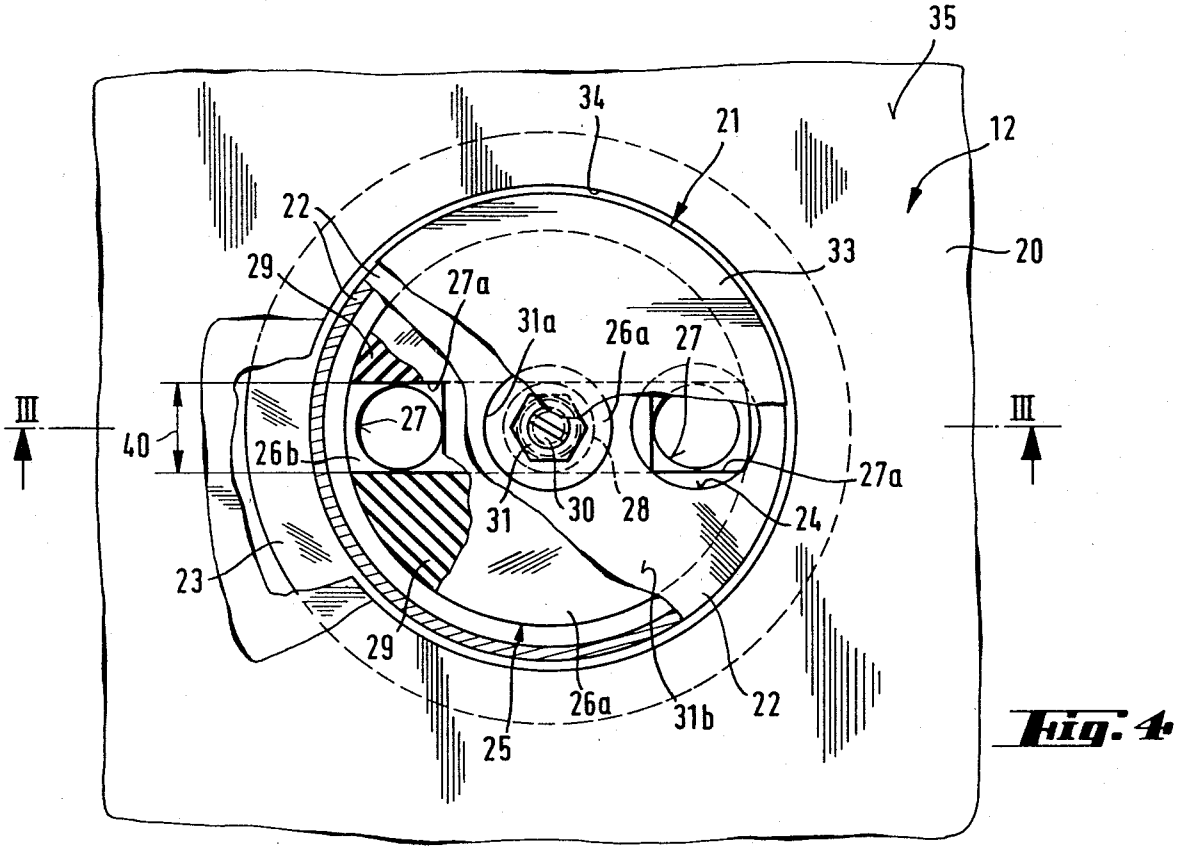
FIG. 4 is a partly sectioned top view of the illustration of FIG. 3.

FIG. 4 illustrates as a top view the arrangement of FIG. 3 partly sectioned. The distance 40 between two rubber pads 29 is so dimensioned, that said attachment by welding and the placing of bushing 28 are easily carried out.

The invention is not limited to the embodiments shown, but several modifications thereof are feasible within the scope of the attached claims.

We claim:

1. A method of providing a floor on a substantially even underlaying, comprising:

providing a self-supporting floor structure having a top and a bottom and having at least one damper appliance attached thereto and projecting beyond the bottom of the floor structure by an amount which is adjustable from on top of the floor structure, transporting the floor structure to the desired position on the underlaying, attaching the damper appliance to the underlaying, and adjusting the damper appliance so as to bring the floor structure to a position in which it is out of direct mechanical contact with the underlaying over substantially the entire area of the bottom of the floor structure.

2. A method according to claim 1, comprising:

providing walls each having a top and a bottom and also providing a ceiling structure, attaching the walls at their bottoms to the floor structure and attaching the ceiling structure to the tops of the walls.

3. A method according to claim 1, wherein the damping appliance is adjusted to a position in which it does not project beyond the top of the floor structure.

4. A method according to claim 1, wherein the floor structure is composed of a plurality of substantially identical cassete-like units.

5. A method according to claim 1, wherein the floor structure is formed with an opening and the method comprises positioning the damper appliance in the opening.

6. A method according to claim 1, wherein the damper appliance includes a flexible damper member, and the method comprises positioning the damper appliance and the floor structure such that the flexible damper member is effective between the floor structure and the underlaying.

7. A method according to claim 1, wherein the underlaying is made of metal and the method comprises attaching the damper appliance to the underlaying by welding.

8. A room unit which can be installed on a substantially even underlaying, comprising a self-supporting floor structure having a top, a bottom and a periphery, walls attached to the floor structure about the periphery thereof, and at least one damper appliance which is attached to the floor structure and projects beyond the bottom of the floor structure by an amount which is adjustable from on top of the floor structure, whereby when the room unit is installed on the underlaying, the floor structure can be brought to a position in which it is out of direct mechanical contact with the underlaying over substantially the entire area of the bottom of the floor structure.

9. A room unit according to claim 8, being a box-like cabin unit having, in addition to the floor structure and the walls, a ceiling structure attached to the walls.

10. A room unit according to claim 8, wherein the damper appliance comprises a body member which is attached to the floor structure, a base member for attaching the damper appliance to the underlayingwhen the floor structure is installed on the underlaying, and at least one adjustment member for adjusting the position of the base member relative to the body member.

11. A room unit according to claim 8, wherein the floor structure is formed from a plurality of substantially identical self-supporting cassette units and the damper appliance is disposed so that it does not project beyond the top of the floor structure.

12. A room unit according to claim 8, wherein the floor structure is formed with a substantially round opening which extends therethrough and in which the damper appliance is disposed.

13. A room unit according to claim 12, wherein the floor structure is formed from a plurality of substantially identical self-supporting cassette units, each comprising a cassette housing and a load-bearing profiled plate element which is located inside the cassette housing.

14. A room unit according to claim 13, wherein the cassete housing and the profiled element of the cassette unit are attached together through adhesive bonding.

15. A room unit according to claim 8, in which the damper appliance comprises a rigid body member for supporting the floor structure, a base member which can be attached to the underlaying when the room unit is installed on the underlaying, a flexible damper member for damping vibrations, and at least one adjustment member for adjusting the distance between the base member and the rigid body member.

16. A room unit according to claim 15, wherein the adjustment member is a screw-threaded member and the flexible damper member is made from a material having a property selected from the group consisting of elasticity and plasticity

17. A room unit according to claim 16, wherein the damping member is made from a material selected from the group consisting of rubber, polystyrene and mineral wool.

18. A room unit according to claim 8, wherein the damper appliance comprises a body member for engaging the bottom of the floor structure, a base member for attachment to the underlaying, and adjustment means for adjusting the distance between the base member and the body member, said adjustment means including an adjustment member that extends substantially to the top of the floor structure.

19. A room unit according to claim 18, wherein the adjustment means comprise members for locking the base member at a predetermined distance from the body member.

20. A room unit according to claim 18, wherein the floor structure is formed with an opening into which the damper appliance extends, and the body member of the damper appliance has a lower portion which engages the bottom of the floor structure, an intermediate portion which extends within the opening of the floor structure, and an upper portion having a non-recessed part which is adjacent the top of the floor structure and a recessed part which is nearer the bottom of the floor structure than is the non-recessed part and forms a depression, and wherein the adjustment means include a member that extends through the recessed part of the upper portion of the body member and projects into the recess but does not project beyond the non-recessed part of the upper portion of the body member.

21. A room unit according to claim 17, wherein the body member comprises a flange portion which engages the bottom of the floor structure.

22. A room unit according to claim 8, in which the damper appliance is adjustable to project beyond the bottom of the floor by an amount that is at least 25 mm.

23. A room unit according to claim 8, wherein the damper appliance comprises a base member for engaging the underlaying, the base member being made of metal so that the damper appliance can be attached to a metal underlaying by welding.

24. A room unit according to claim 23, wherein the base member is formed with an opening so that the damper appliance can be attached to a metal underlaying by welding about the periphery of the opening.

25. A room unit according to claim 8, wherein the perpendicular distance between the top and bottom of the floor structure is within the range from 25 mm to 50 mm.

26. A room unit according to claim 8, comprising a layer of vibration absorbing material attached to the floor structure at its bottom.

27. A room unit according to claim 26, wherein the vibration absorbing material is mineral wool having a density of at most 100 kg/m$^3$.

28. A room unit according to claim 8, wherein the damper appliance is formed with an opening which provides access to the underlaying from on top of the floor structure to facilitate attachment of the damper appliance to the underlaying.

29. A construction having a substantially even underlaying made of metal, a self-supporting floor structure disposed on the underlaying and having a top and a bottom, and at least one damper appliance attached to and effective between the floor structure and the underlaying, the damper appliance maintaining the floor structure in a position in which it is out of direct mechanical contact with the underlaying over substantially the entire area of the bottom of the floor structure, and the damper appliance having adjustment means which are accessible from the top of the floor structure for adjusting the position of the floor structure relative to the underlaying.

30. A construction according to claim 29, disposed for use in a marine environment.

31. A construction according to claim 29, comprising a layer of vibration absorbing material attached to the bottom of the floor structure and interposed between the floor structure and the underlaying.

32. A construction according to claim 31, wherein the vibration absorbing material is mineral wool having a density of at most 100 kg/m$^3$.

33. A construction according to claim 29, wherein the damper appliance comprises a body member that engages the floor structure and a base member that engages the underlaying, the base member being attached to the underlaying.

34. A construction according to claim 33, wherein the underlaying and the base member are both made of metal, and the base member is attached to the underlaying by welding

* * * * *